US010485282B2

(12) United States Patent
Coursimault

(10) Patent No.: US 10,485,282 B2
(45) Date of Patent: Nov. 26, 2019

(54) CHIN STRAP CONNECTOR WITH VARIABLE BREAKING

(71) Applicant: ZEDEL, Crolles (FR)

(72) Inventor: Antoine Coursimault, Grenoble (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 15/296,457

(22) Filed: Oct. 18, 2016

(65) Prior Publication Data

US 2017/0119079 A1 May 4, 2017

(30) Foreign Application Priority Data

Nov. 3, 2015 (FR) ..... 15 60496

(51) Int. Cl.

*A42B 3/08* (2006.01)
*A42C 2/00* (2006.01)
*A44B 11/25* (2006.01)

(52) U.S. Cl.

CPC ..... *A42B 3/08* (2013.01); *A42C 2/00* (2013.01); *A44B 11/2569* (2013.01)

(58) Field of Classification Search

CPC .. A42C 2/00; A42B 3/08; A44B 11/25; A44B 11/2542; A44B 11/2569; Y10T 24/45529; Y10T 24/45461

USPC ..... 2/421

See application file for complete search history.

(56) References Cited

U.S. PATENT DOCUMENTS 4,110,847 A * 9/1978 Dera ..... A42B 3/08 2/421
5,077,839 A * 1/1992 Keller ..... A42B 3/08 2/421
5,319,836 A * 6/1994 Ida ..... A44B 11/263 24/614
5,383,257 A * 1/1995 Krauss ..... A44B 11/266 24/616
5,459,910 A * 10/1995 Anscher ..... A42B 3/08 2/421
5,666,700 A * 9/1997 Anscher ..... A42B 3/08 2/421
8,353,066 B2 * 1/2013 Rogers ..... A42B 3/085 2/417
2003/0217441 A1 11/2003 Eaton et al.

(Continued)

FOREIGN PATENT DOCUMENTS

WO 2014/103009 A1 7/2014

*Primary Examiner* — Anne M Kozak
(74) *Attorney, Agent, or Firm* — Oliff PLC

(57) ABSTRACT

A connector including: first part designed to be connected to crown of protective helmet, second part designed to be connected to crown of protective helmet and fitted in removable manner on first part, connecting part mechanically connecting first part and second part so as to form first mechanical connection, movable part moving between first and second positions and configured: to prevent first and second parts from coming detached from one another when the parts are subjected to first threshold tensile force, when movable part is in first position, to enable first and second parts to be detached from one another when the parts are subjected to second threshold tensile force lower than that of first threshold tensile force, when movable part is in second position. The invention also relates to protective helmet provided with one such connector, as well as to an assembly method of such connector.

18 Claims, 4 Drawing Sheets

(56) References Cited

U.S. PATENT DOCUMENTS

| | | | | |
|---|---|---|---|---|
| 2007/0199182 | A1* | 8/2007 | Johnson | A44B 11/2542<br>24/265 BC |
| 2008/0010790 | A1* | 1/2008 | Dillner | A44B 11/2523<br>24/630 |
| 2008/0028579 | A1* | 2/2008 | Chen | A44B 11/2511<br>24/625 |
| 2011/0072547 | A1* | 3/2011 | Doria | A42B 3/08<br>2/2.5 |
| 2016/0278487 | A1* | 9/2016 | Postolek | A44B 11/2573 |

* cited by examiner

CHIN STRAP CONNECTOR WITH VARIABLE BREAKING

BACKGROUND OF THE INVENTION

The invention relates to a chin strap connector with variable breaking, and to a protective helmet provided with at least one such connector.

STATE OF THE ART

Protective helmets used for the pursuit of a sport or for a professional activity do not have to meet the same requirements.

In the scope of a professional activity, a protective helmet does in fact have to be able to be released from the user's head if a tensile force greater than a certain threshold is exerted on the crown of the helmet. For example, a tree pruner may be hung by his helmet if the latter is caught on a branch of a tree and he is unable to free it. The chin strap could therefore strangle the person wearing the helmet.

To prevent this type of danger, the protective helmet has to comply with drastic safety requirements. In particular the chin strap has to be able to be released from the crown if it is subjected to a tensile force greater than a certain threshold. The user's head is then freed and he can no longer be strangled by the chin strap.

In Europe, this safety rule is governed by the EN 397 Standard which imposes on the maker to manufacture protective helmets comprising at least one anchoring point of the chin strap on the crown, which are configured to break when the chin strap is subjected to a tensile force comprised between 150 and 250 Newtons.

In the scope of a sporting activity, the main danger threatening the user is a rock fall. It is therefore fundamental that the protective helmet be able to resist shocks and that the chin strap remain fixed to the crown for the user to remain properly protected.

In Europe, a protective helmet used for a sporting activity must comply with the EN 12492 Standard. This standard imposes that the fixing system of the chin strap on the crown be able to undergo a tensile force of at least 500 Newtons without the protective helmet being damaged.

These two standards are incompatible with one another. Consequently, a user needing a protective helmet for the purposes of a sporting activity and for a professional activity has to have not one but two protective helmets.

Furthermore, manufacturing of helmets requires the development of two types of products and implementation of two different production lines.

OBJECT OF THE INVENTION

One object of the invention consists in providing a chin strap connector that is able to be adapted to the two types of requirements set out in the foregoing so as to enable a single helmet to be used for a professional activity and for the pursuit of a sport.

For this purpose, the connector comprises:

- a first part designed to be attached to a crown of a helmet,
- a second part designed to be fitted in removable manner on the first part,
- a connecting part mechanically connecting the first part and the second part so as to form a first mechanical connection,
- a movable part able to move between first and second positions and configured:
  - to prevent the first and second parts from coming detached from one another when said parts are subjected to a first threshold tensile force, when the movable part is in the first position,
  - to enable the first and second parts to be detached from one another when said parts are subjected to a second threshold tensile force lower than that of the first threshold tensile force, when the movable part is in the second position.

According to a specific embodiment, the connecting part can comprise an independent part having a first end and a second end opposite the first end, the first end being attached to the first part and the second end being attached to the second part. In this case, the connecting part can be configured to enable the first and second parts to be detached from one another by breaking of the connecting part when the movable part is in the second position.

According to a particular embodiment of the invention, the connecting part can be partially positioned in a housing of the first part and collaborate with clip-fastening means placed on the second part so as to form the first mechanical connection.

Furthermore, the movable part can be configured to form an additional mechanical connection between the first part and the second part when it is placed in the first position. For this, the movable part can for example collaborate with a stud placed on the connector. The movable part can further be mounted movable in rotation.

According to a particular embodiment of the connector, the latter can comprise a closing part designed to close a strap of a protective helmet and/or to adjust its length.

The invention also relates to a protective helmet comprising a crown, a chin strap and at least one connector comprising the above-mentioned technical features.

When the protective helmet comprises a single connector, the first threshold tensile force exerted on the chin strap can be greater than 500 N, and the second threshold tensile force exerted on the chin strap can be comprised between 150 and 250 N, this tensile force being applied between the helmet and the chin strap.

According to one embodiment of the helmet, the first part of at least one of the connectors can be attached to the crown by means of an additional strap and the second part of said connector can be attached to the chin strap.

According to an alternative embodiment, the first part of at least one of the connectors can be attached to the chin strap, and the second part of said connector can be attached to the crown.

The invention also relates to a method for assembling a connector comprising the above-mentioned technical features. This comprises the following steps:

- providing the first part, the second part and the connecting part,
- mechanically connecting the first and second parts by means of the connecting part so as to prevent the first and second parts from coming detached from one another when said parts are subjected to a tensile force lower than the second threshold tensile force.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
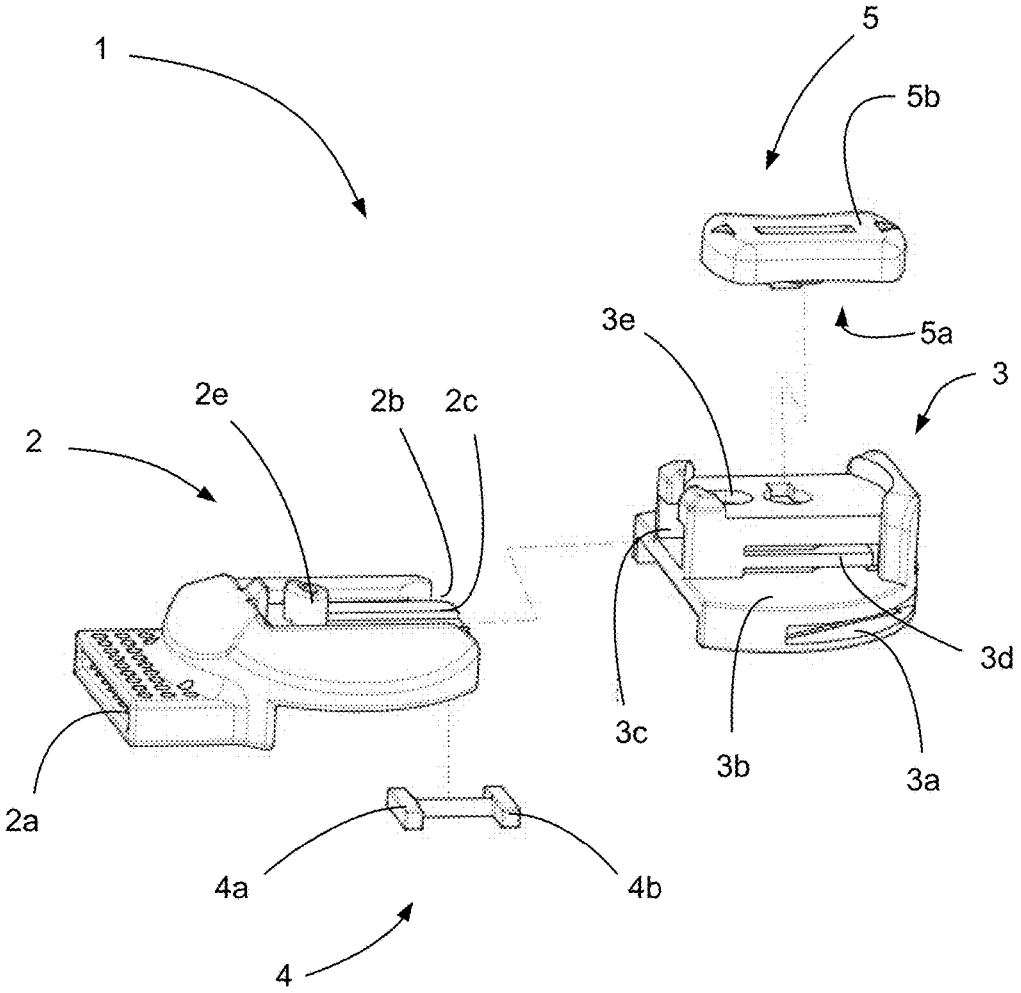
FIG. 1 represents an exploded and perspective view of a connector.

According to an embodiment of a connector 1, the latter comprises a first part 2, a second part 3, a connecting part 4, and a movable part 5.

The first part 2 comprises a main attachment area 2*a* designed to be fixed directly or indirectly to a crown of a protective helmet, and is for example designed to house at least one strap, as will be seen further on. The second part 3 also comprises one or more additional attachment areas 3*a* designed to be fixed directly or indirectly to a crown of the helmet and designed for example to collaborate with one or two straps. The main and additional attachment areas 2*a* and 3*a* advantageously have the form of a slot for ease of connection with a strap.

In the following, the longitudinal axis of the connector 1 is defined as being the axis of the strap housed in the main attachment area 2*a*. It is represented by the line AA in FIGS. 2 to 4.

The first and second parts 2 and 3 are fitted in removable manner with respect to one another, and they can therefore be fitted and removed without breaking. In advantageous manner, a part of the first part 2 slides inside a cavity of the second part 3 and/or a part of the second part 3 slides inside a cavity of the first part 2. This sliding assembly enables the forces to be applied on the connecting part 4 to be defined more easily.

The first and second parts 2 and 3 are mechanically connected by means of the connecting part 4 so as to prevent the first and second parts from coming detached from one another.

In the illustrated embodiment, the first part 2 comprises two slots 2*b* situated on the longitudinal axis and defining a central part 2*c*. An embodiment with a single slot can also be envisaged. The second part 3 comprises a base 3*b* on which a first housing 3*c* is located. The central part 2*c* of the first part 2 and the first housing 3*c* of the second part 3 have suitable dimensions so as to enable them to be engaged in one another, the side walls of the first housing 3*c* sliding in the slots 2*b*. An alternative embodiment wherein the first part 2 has more than two slots 2*b* is also conceivable.

The connecting part 4 enables the first part 2 and second part 3 to be mechanically connected. It can comprise a part independent from the first and second parts 2 and 3. The latter is for example H-shaped, but other suitable shapes are also possible, a circle, a square, or a rectangle. In an advantageous embodiment, the connecting part 4 is used as a tensile test bar, i.e. it forms a first mechanical connection between the parts 2 and 3 until the part is broken due to the effect of a tensile force (cf. FIG. 5). The connecting part 4 is therefore a fusible part that is able to be replaced in case of malfunctioning of the connector 1. Breaking of the connecting part 4 enables it to be quickly detected that the connector has been stressed beyond a threshold value.

According to an alternative embodiment, a system can be provided for the connecting part 4 to be released by the first or second part when a threshold tensile force is reached without the connecting part 4 being broken.

According to another alternative embodiment, the connecting part 4 can form an integral part of either the first or second part 2 or 3, in which case it is the whole of the part which has to be replaced in case of breaking.

In the embodiment illustrated in the figures, the connecting part 4 is an independent part. A first end 4*a* of the connecting part 4 is placed in a second housing 2*d* situated on the central part 2*c* of the first part 2. The shape of the second housing 2*d* is advantageously complementary to the shape of the end of the connecting part 4 for the latter to be kept fixed in the direction of the longitudinal axis. When the central part 2*c* of the first part 2 is engaged in the first housing 3*c* of the second part 3, the connecting part 4 is placed inside the first housing 3*c*. The latter comprises clip-fastening means 3*d* designed to collaborate with the connecting part 4 in order to form a first mechanical connection between the first and second parts (cf. FIG. 4).

However, the clip-fastening means can be replaced by a ramp terminated by a flat section forming a fixing area. In this way, the connecting part 4 moves up the ramp without a large force being supplied. The connecting part 4 then falls into the fixing area where a higher force will have to be applied to make it leave the fixing area or to cause breaking of the connecting part 4.

In general manner, it is advantageous to use coupling means which require a first force to initiate coupling by moving the connecting part 4 in a first direction, and a second force higher than the first force to eliminate this coupling by attempting to move the connecting part 4 in a second direction opposite to the first direction.

The connecting part 4 is for example mounted on the first part 2 or on the second part 3. When sliding of the first part 2 in the second part 3 or of the second part 3 in the first part 2 takes place, the mechanical connection is created by means of the connecting part 4.

According to the particular embodiment illustrated, the clip-fastening means correspond to hooked fingers 3*d* belonging to the side walls of the first housing 3*c*. This embodiment presents the advantage of being particularly compact and efficient.

When the central part 2*c* provided with the connecting part 4 is inserted in the first housing 3*c* of the second part, the connecting part 4 pushes the hooked fingers 3*d* until a second end 4*b* of the connecting part 4 moves past them. The connecting part 4 then forms the first mechanical connection between the first and second parts 2 and 3. It is impossible to remove the central part 2*c* from the first housing 3*c* without breaking the connecting part 4 (cf. FIGS. 4 and 5).

As an alternative embodiment, the above-mentioned coupling means may not be used. It is necessary in this case to dismantle the connector in order to place the connecting part in such a way as to make the mechanical connection between the two parts. This embodiment is less practical.

As indicated in the foregoing, if the connecting part 4 is subjected to a tensile stress beyond a threshold force, the first part 2 is detached from second part 3.

When the user wants to resist this tensile force or on the contrary to yield to a lower force, it is advantageous to provide means for modifying the value of the uncoupling force. The movable part 5 is used to modify the mechanical connection which exists between the first part 2, the second part 3 and the connecting part 4. The movable part 5 can be placed at least in a first position or in a second position.

In a first case, the movable part 5 is configured to make or to eliminate a direct mechanical connection between the first part 2 and the second part 3. This mechanical connection is advantageously used to avoid stressing the connecting part 4 and to withstand a higher tensile force than the mechanical connection formed by the connecting part 4. In this manner, the connector 1 is able to withstand a larger load.

In a second case, the movable part 5 is configured to modify the mechanical connection between the first part 2 and the second part 3 by means of the connecting part 4. In this embodiment, the connecting part 4 comprises for example a gripping area for the first part 2 and several different gripping areas for the second part 3. The different gripping areas enable different areas of the connecting part 4 to be stressed.

In another case, the movable part 5 is configured to move one end of the connecting part 4 so that the latter collaborates with additional coupling means. The additional coupling means can for example be arranged above or below the coupling means. The coupling means and additional coupling means are both formed by grips forming clips. The two coupling means are configured to have different tensile strengths in collaboration with the connecting part 4. For example, the coupling means are configured to resist beyond the breaking threshold of the connecting part 4 whereas the additional coupling means are configured to allow release of the connecting part 4 before breaking of the latter.

The movable part 5 can therefore be configured to move the coupling means and additional coupling means so that the latter fix the disconnection thresholds between the first and second parts 2 and 3.

The movable part 5 can also be configured to move the connecting part 4 so that it is coupled to the coupling means or to the additional coupling means.

It is further possible to provide for the movable part 5 to be configured to apply a stress on the connecting part 4 in order to no longer make the latter work in traction but for example in flexion. The breaking force is then modified.

Figure 2:
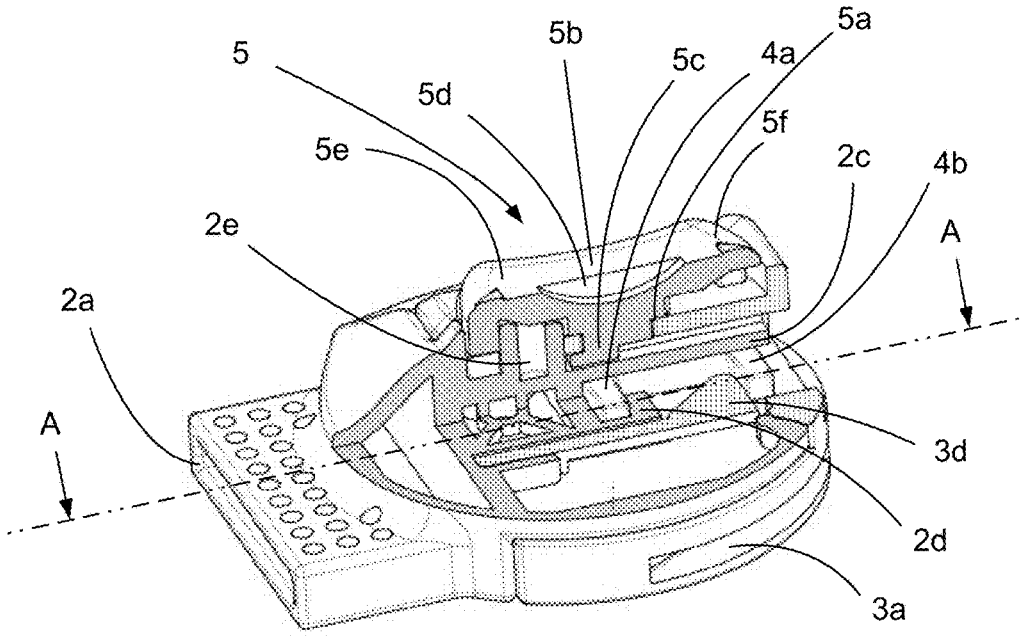
FIGS. 2 and 3 represent the connector in cross-sectional view and in perspective view when the movable part is respectively in the first and second positions.
Figure 3:
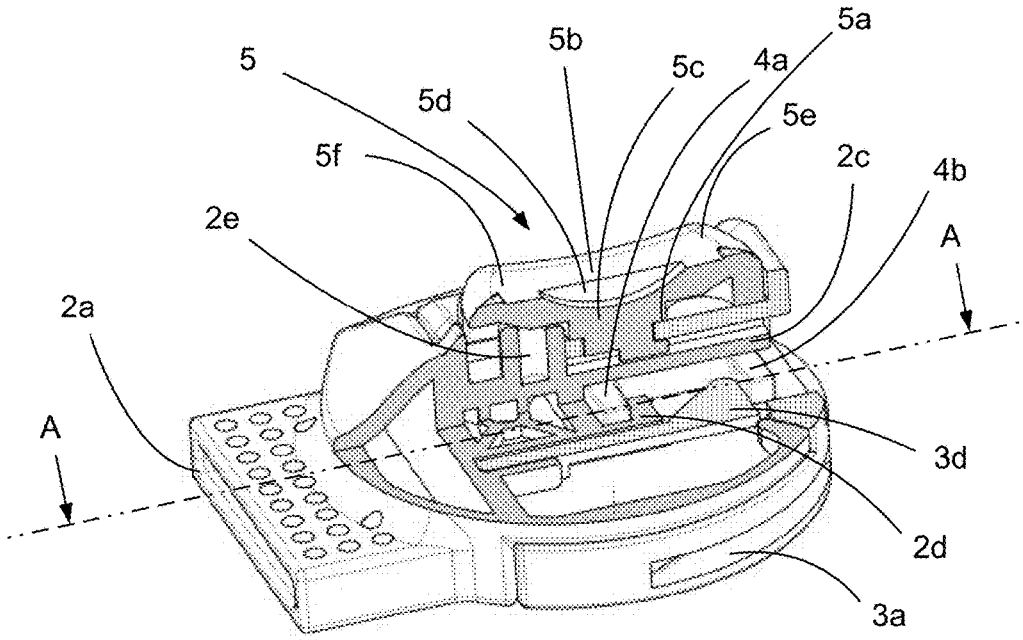
Figure 4:
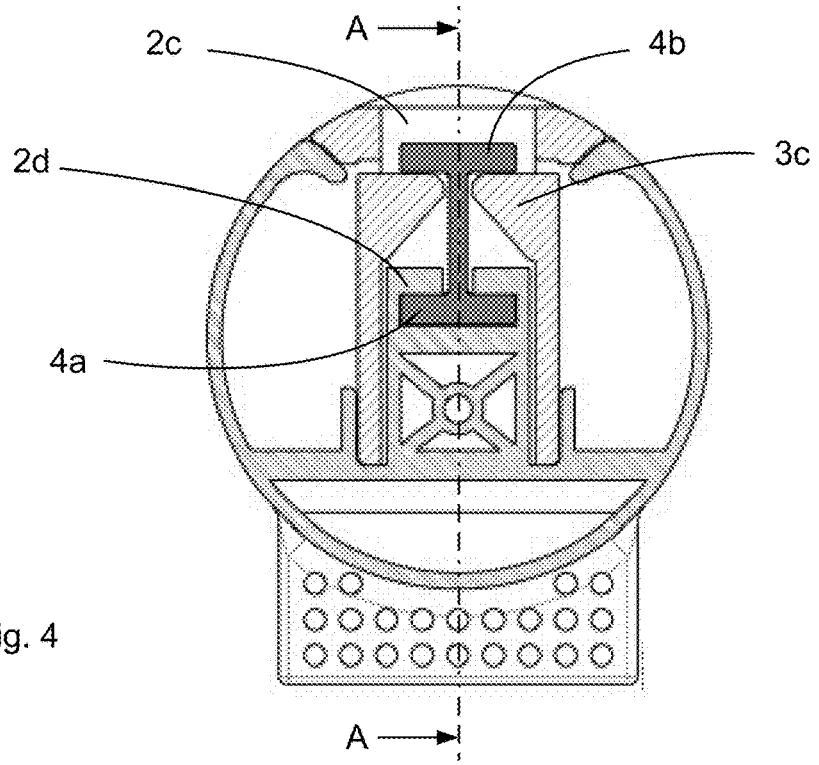
FIGS. 4 and 5 are cross-sectional views of the connector illustrating the position of the connecting part with respect to the first and second parts, respectively when the connector is able to function and when it is no longer able to function.

According to embodiment illustrated in FIGS. 1, 2 and 3, the movable part 5 is positioned on the top wall of the first housing 3*c* (cf. FIG. 2). The bottom surface 5*a* of the movable part 5 is defined as being in contact with the top wall of the first housing 3*c* and the top surface 5*b* as being the surface opposite the bottom surface 5*a*.

The movable part 5 is mounted movable in rotation with respect to the assembly comprising the first part 2, the second part 3 and the connecting part 4. Mounting in rotation is preferred to mounting in translation as the probability of switching between the first and second positions in unintentional manner is lower.

To enable rotation of the movable part 5, the top part of the first housing 3*c* has a hole collaborating with a salient portion 5*c* positioned on the bottom surface 5*a* of the movable part 5.

The movable part 5 is able to move between first and second positions. In the particular embodiment illustrated in the figures, the movable part 5 can rotate through 180°. The user can move the part manually or by means of a tool. A notch 5*d* can for example be provided to rotate the movable part 5 by means of a coin. A rotation of an angle greater than or equal to 90° is advantageous to distinguish between the first and second positions as this reduces the risks of unintentional actuation.

The movable part 5 advantageously comprises first and second ends 5*e* and 5*f* for example opposite one another along the longitudinal axis of the connector 1. The first end 5*e* of the movable part 5 is provided with a stop orthogonal to the longitudinal axis, whereas the second end 5*f* of the movable part 5 is not provided with a stop.

The arresting surface of the first end 5*e* of the movable part 5 is designed to collaborate with a stud 2*e* present on the central part 2*c* of the first part 2. When the central part 2*c* is inserted in the first housing 3*c*, the stud 2*e* is inserted in a notch 3*e* placed on the top wall of the first housing 3*c*. The notch 3*e* is advantageously placed along the longitudinal axis of the connector 1. The stud 2*e* is therefore salient through the first housing 3*c*.

When the movable part 5 is placed in the first position (cf. FIG. 2), the arresting surface of the first end 5*e* of the movable part 5 collaborates with the stud 2*e* so as to prevent the first and second parts 2 and 3 from coming detached when they are subjected to a first threshold tensile force. The arresting surface of the first end 5*e* of the movable part 5 and the stud 2*e* form an additional mechanical connection between the first and second parts 2 and 3, preventing the connecting part from being tensioned.

When the movable part 5 is placed in the second position (cf. FIG. 3), the stud 2*e* does not play any role as the second end 5*f* of the movable part 5 does not comprise an arresting surface. In this way, when the first and second parts 2 and 3 are subjected to a tensile force, it is possible to detach them from one another for a second threshold tensile force of lower intensity than that of the first threshold tensile force.

The movable part 5 thus forms an additional mechanical connection between the first part 2 and second part 3 when it is placed in the first position. The connector 1 can resist tensile forces of larger intensity when the movable part 5 is in the first position than when it is in the second position.

In the embodiment presented above, the movable part 5 does not form any mechanical connection when it is in the second position. It can however be envisaged to provide a movable part 5 forming a mechanical connection in the first and second positions, provided that the mechanical connection in the first position enables higher tensile forces to be resisted than the mechanical connection in the second position.

When the movable part 5 is in the first position, the connector 1 can advantageously resist a first threshold tensile force along the longitudinal axis. In this manner, for the helmet to be suitable to be used for the pursuit of a sport, a connector 1 such as the one which has just been described simply has to be used and the movable part 5 be placed in the first position.

Figure 5:
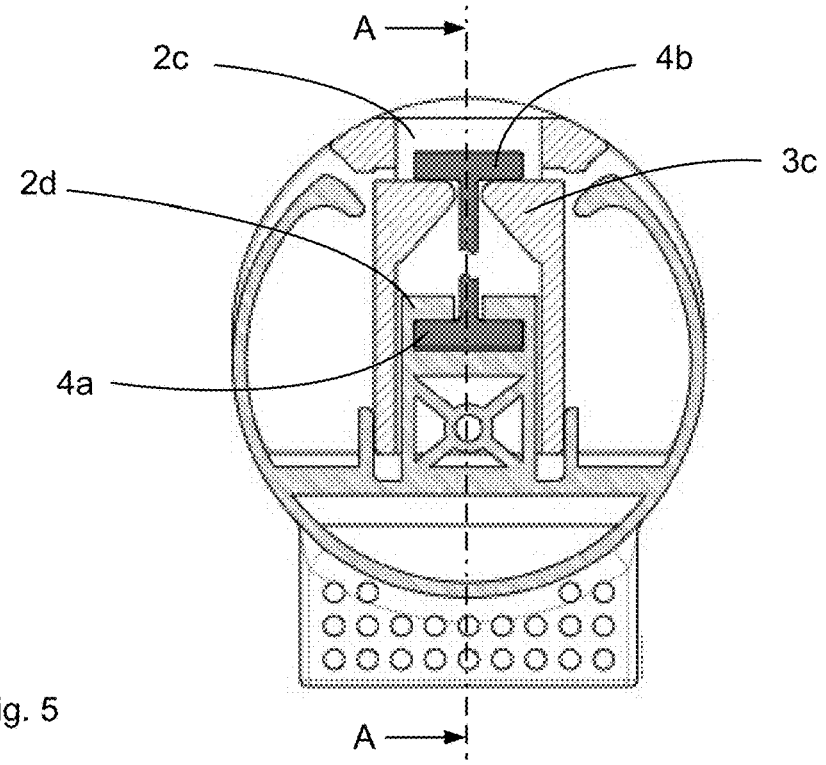

When the movable part 5 is placed in the second position, it can advantageously allow detachment of the first and second parts 2 and 3 by breaking of the connecting part 4 (cf. FIG. 5). The second threshold tensile force enabling detachment of the parts 2 and 3 can advantageously be comprised between 150 and 250 N. A protective helmet can therefore be suitable for use for professional purposes when a connector 1 is used and the movable part 5 is placed in the second position.

Naturally, if the safety standards for protective helmets for professional use and for sporting use change, it is quite possible to modify the technical characteristics of the connector 1 in order to adjust its resistance to other threshold tensile forces. For this, the shape of the different parts of the connector and the material from which these parts are manufactured can be modified in order to be more or less strong depending on whether the movable part 5 is placed in the first or in the second position.

In advantageous manner, the movable part 5 can be configured to prevent mechanical connection between the first part 2 and the second part 3 when it is in the first position. This precaution prevents the first and second parts of the connector 1 from coming detached whereas the connecting part 4 was forgotten when assembly was performed.

According to a particular embodiment of the connector 1, the latter can comprise a closing part 8 designed to close a strap of a protective helmet. The closing system of the straps of the protective helmet and the connector 1 then form one and the same part which the user has to adjust according to the type of use he envisages (professional or sport).

Figure 6:
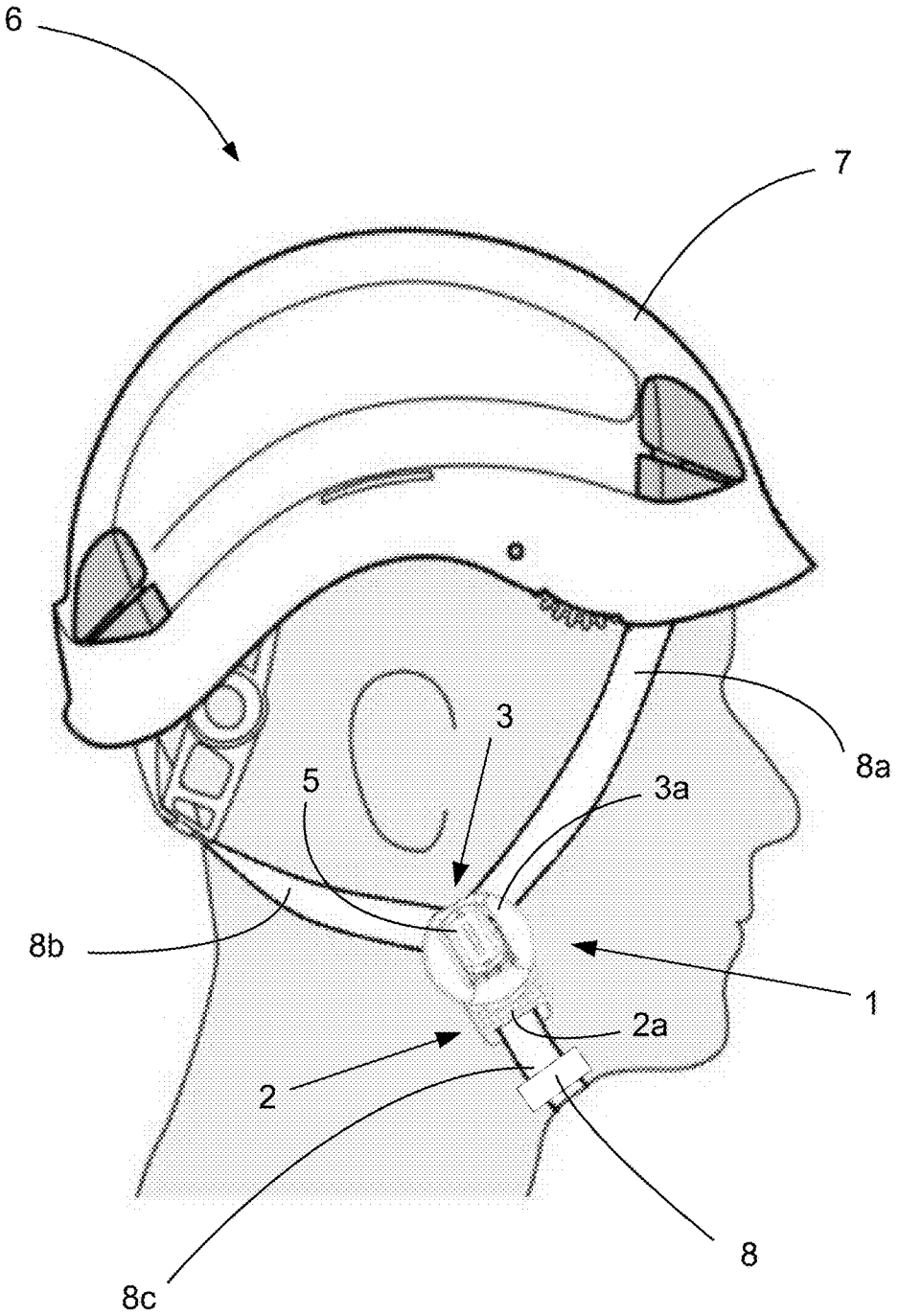
FIG. 6 illustrates an embodiment of a protective helmet provided with a connector, in schematic manner.

FIG. 6 presents an embodiment of a protective helmet 6 provided with at least one connector 1 such as the one which has just been described. The protective helmet 6 also comprises a crown 7 and a chin strap connected directly or indirectly and in removable manner to the crown 7 to enable the user to place the protective helmet 6 on his head.

According to an embodiment as illustrated in FIG. 6, the first part 2 of the connector 1 can be attached to the crown 7 via an additional strap, and the second part 3 can be attached to the chin strap. According to an alternative embodiment that is not represented, it can be envisaged that the first part 2 of the connector 1 be attached to the chin strap, possibly by an intermediate part such as an additional strap, and that the second part 3 of the connector 1 be connected to the crown 7.

According to the embodiment illustrated in FIG. 6, the protective helmet 6 comprises a single connector 1 attached to a front strap 8*a*, to a rear head strap 8*b* and to the chin strap 8*c*. More precisely, the chin strap 8*c* is connected to the first part 2 via the main attachment area 2*a*, and the front and rear straps are connected to the second part by the additional attachment areas 3*a*.

In this embodiment, when the movable part 5 of the connector 1 is placed in the first position, the connector is configured to prevent the first and second parts from being detached from one another when the chin strap 8*c* is subjected to a threshold tensile force $F_1$ preferentially greater than 500 N. The tensile force $F_2$ received by the connector is lower by half, i.e. preferably greater than 250 N. The connector 1 is therefore configured to withstand forces equal to 50% of the force exerted between the protective helmet 6 and chin strap 8*c*.

Breaking of the connector 1 enables the user's head to be freed when the movable part 5 is placed in the second position, i.e. during use for professional purposes. The first and second parts 2 and 3 are then detached from one another when the chin strap 8*c* is subjected to a second threshold tensile force comprised between 150 and 250 N. This prevents the user from being strangled by the chin strap 8*c* if the crown 7 is jammed.

According to an alternative embodiment, the chin strap 8*c* can be attached on one side of the protective helmet 6 by the connector 1 and be fixed on the other side of the protective helmet 6 either directly or by means of an adjustment loop.

According to an alternative embodiment (not shown), the protective helmet 6 can comprise several connectors fitted in parallel on the same lateral side of the crown 7. In this case, the first and second threshold tensile forces are divided by the number of connectors fitted in parallel on the protective helmet 6.

For example, the protective helmet 6 can comprise a first connector connecting the crown 7 to the front strap 8*a*, and a second connector connecting the crown 7 to the rear head strap 8*b*. The first and second connectors are advantageously placed either on the left side or on the right side of the crown 7. In this way, when they break they cause the chin strap 8*c* to be released. In this case, the two connectors are then configured for the first threshold tensile force to be greater than $F_1/4$, i.e. preferentially greater than 125 N, and for the second threshold tensile force to be comprised between 37.5 and 62.5 N.

It is therefore possible to provide a protective helmet 6 able to be used both for a professional activity and for the pursuit of a sport. The user has to take care to place the movable part 5 of the connector 1 or connectors in the first or second position depending on the activity involved in order to use the helmet under optimum conditions.

The invention also relates to the assembly method of a connector 1 as it has just been described. The method comprises the following steps:

providing the first part 2, the second part 3 and the connecting part 4, mechanically connecting the first part 2 and second part 3 by means of the connecting part 4 so as to prevent the first and second parts from coming detached from one another when said parts are subjected to a tensile force lower than the second threshold tensile force.

The invention claimed is:

1. A connector comprising:

a first part designed to be connected to a crown of a protective helmet, a second part designed to be connected to the crown of the protective helmet and fitted in removable manner on the first part, a connecting part mechanically connecting the first part and the second part so as to form a first mechanical connection, a movable part mounted on the second part and movable between first and second positions and configured:

to form an additional mechanical connection between the first part and the second part so as to prevent the first and second parts from coming detached from one another when the first and second parts are subjected to a first threshold tensile force, when the movable part is in the first position, to enable the first and second parts to be detached from one another when the first and second parts are subjected to a second threshold tensile force lower than that of the first threshold tensile force, when the movable part is in the second position.

2. The connector according to claim 1, wherein the connecting part comprises a separately-formed part having a first end and a second end opposite the first end, the first end being connected to the first part and the second end being connected to the second part.

3. The connector according to claim 1, wherein the connecting part is configured to enable the first and second parts to be detached from one another by breaking of the connecting part when the movable part is in the second position.

4. The connector according to claim 1, wherein the connecting part is partially positioned in a housing of the first part and collaborates with hooked finger portions located on the second part so as to form the first mechanical connection.

5. The connector according to claim 1, comprising a stud configured to collaborate with the movable part so as to form the additional mechanical connection.

6. Connector according to claim 1, wherein the movable part is movable in rotation.

7. The connector according to claim 1, comprising a closing part designed to close a chin strap of the protective helmet or to adjust its length.

8. An assembly method of the connector according to claim 1 comprising the following steps:

providing the first part, the second part, the connecting part, and the movable part, mechanically connecting the first and second parts by connecting part so as to form the first mechanical connection, moving the movable part in the first position to form the additional mechanical connection between the first and second parts so as to prevent the first and second parts from coming detached from one another when the first and second parts are subjected to the first threshold tensile force, and moving the movable part in the second position to enable the first and second part to be detached from one another when the first and second parts are subjected to a second threshold tensile force lower than that of the first threshold tensile force.

9. A protective helmet comprising a crown, a chin strap, and at least one connector, said at least one connector comprising:

a first part connected to the crown, a second part connected to the crown and fitted in removable manner on the first part, a connecting part mechanically connecting the first part and the second part so as to form a first mechanical connection, a movable part mounted on the second part and movable between first and second positions and configured:

to form an additional mechanical connection between the first part and the second part so as to prevent the first and second parts from coming detached from one another when the first and second parts are subjected to a first threshold tensile force, when the movable part is in the first position, and to enable the first and second parts to be detached from one another when the first and second parts are subjected to a second threshold tensile force lower than that of the first threshold tensile force, when the movable part is in the second position.

10. The protective helmet according to claim 9, wherein the first part of said at least one connector is connected to the chin strap, and wherein the second part of said at least one connector is connected to the crown.

11. The protective helmet according to claim 10, wherein the first threshold tensile force is greater than 500 N.

12. The protective helmet according to claim 10, wherein the second threshold tensile force is between 150 and 250 N.

13. The protective helmet according to claim 9, wherein the connecting part comprises a separately-formed part having a first end and a second end opposite the first end, the first end being connected to the first part and the second end being connected to the second part.

14. The protective helmet according to claim 9, wherein the connecting part is configured to enable the first and second parts to be detached from one another by breaking of the connecting part when the movable part is in the second position.

15. The protective helmet according to claim 9, wherein the connecting part is partially positioned in a housing of the first part and collaborates with hooked finger portions located on the second part so as to form the first mechanical connection.

16. The protective helmet according to claim 9, wherein said at least one connector comprises a stud configured to collaborate with the movable part so as to form the additional mechanical connection.

17. The protective helmet according to claim 9, wherein the movable part is movable in rotation.

18. The protective helmet according to claim 9, wherein said at least one connector comprises a closing part designed to close a chin strap or to adjust its length.

* * * * *